US005167468A

United States Patent [19]

Crafton

[11] Patent Number: 5,167,468

[45] Date of Patent: Dec. 1, 1992

[54] SYSTEM FOR THE ROBOTIC FABRICATION OF PIPELINES AND TUNNELS ALONG UNLIMITED THREE-DIMENSIONAL CURVILINEAR PATHS

[76] Inventor: Paul A. Crafton, P.O. Box 6076, Norman, Okla. 73070

[21] Appl. No.: 594,812

[22] Filed: Sep. 28, 1990

Related U.S. Application Data

[63] Continuation-in-part of Ser. No. 432,451, Nov. 6, 1989, abandoned.

[51] Int. Cl.[5] ..... F16L 1/00

[52] U.S. Cl. ..... 405/155; 405/138; 405/146

[58] Field of Search ..... 405/184, 154, 155, 138, 405/141, 142, 156, 135, 136; 425/59, 63

[56] References Cited

U.S. PATENT DOCUMENTS

| | | | |
|---|---|---|---|
| 629,135 | 7/1899 | Nixon et al. | 405/137 X |
| 723,986 | 3/1903 | Carson | 405/136 |
| 1,088,152 | 2/1914 | Jackson | 405/136 |
| 1,303,399 | 5/1919 | Ryan | 405/155 |
| 2,211,589 | 8/1940 | Widmer | 405/135 |
| 2,989,012 | 6/1961 | Cheney | 405/155 |
| 3,979,917 | 9/1976 | Crafton | 405/138 |
| 4,793,736 | 12/1988 | Thompson et al. | 405/146 |

*Primary Examiner*—Dennis L. Taylor
*Attorney, Agent, or Firm*—Paul A. Crafton

[57] ABSTRACT

The present invention is a system for the robotic fabrication of a set of parallel pipelines or tunnels along a curvilinear path without limitation as to distance, direction and depth. A large diameter bore is made by a boring unit as the boring unit moves tangentially along the path through the earth. Prefabricated segments of the pipeline body or tunnel body are then installed by the system at a plurality of locations in the bore, such that their axes are instantaneously parallel to each other and to the large diameter bore, as extensions of the duct body already installed. The annular space between the extensions and the large diameter bore is then occasionally filled along the ducts with a composite material thereby supporting the several smaller diameter structurally independent permanent ducts in the large diameter bore. The prefabricated duct segments function as the structural body of the ducts. Along those segments of the path not through solid material, the prefabricated segments, as successively installed, structurally function as a cantilever bridge through the non-solid region of the path.

35 Claims, 13 Drawing Sheets

SYSTEM FOR THE ROBOTIC FABRICATION OF PIPELINES AND TUNNELS ALONG UNLIMITED THREE-DIMENSIONAL CURVILINEAR PATHS

This application is a continuation-in-part of application Ser. No. 07/432,451, filed Nov. 6, 1989, now abandoned.

This application is a continuation of Ser. No. 432,451 filed Nov. 6, 1989.

FIELD OF THE INVENTION

The present invention relates to systems for the fabrication of pipelines and tunnels, and more particularly to systems for the robotic fabrication of a plurality of parallel pipelines or tunnels along a curvilinear three-dimensional path without limitation as to the distance, direction and depth, and through a combination of solid and non-solid regions of the subterrain of the earth. Prefabricated segments are conveyed through the already-installed segments of the pipelines or tunnels, and installed as the duct body of the next segment. The annular space between the duct bodies and the earthen bore may be occasionally filled in by a composite material, thereby locally encasing the parallel pipelines or tunnels. In non-solid regions in the subterrain, the pipelines or tunnels are not encased.

BACKGROUND OF THE INVENTION

Existing methods for the fabrication of pipelines and tunnels by boring in the subterrain require that the subterrain itself be the body of the pipeline or tunnel. Either postfabricated or prefabricated segments are then installed as the lining of the pipeline or tunnel, to shore up the body of the pipeline or tunnel, or for esthetic purposes.

Existing methods for the installation of prefabricated segments of a pipeline or tunnel require that a trench be cut to a limited depth, the prefabricated segments laid in the trench and joined together, and the trench backfilled. The depth of the pipeline and tunnel is severely limited by the cost of cutting the trench.

The present invention provides for the robotic installation of pipelines at any depth without limitation as to distance and curvature by a system that generates a plurality of parallel pipelines as its boring unit moves omnidirectionally through the earth along a desired three-dimensional path. In contrast to existing methods, the pipeline or tunnel wall does not consist structurally of the wall of the bored subterrain but instead consists structurally of an aggregate of prefabricated sections installed within the bore so as to form a plurality of parallel pipelines/tunnels which are structurally independent.

Existing methods for the installation of pipelines/tunnels require that all tools, devices and equipment, even though activated by power, be manually controlled and applied, and the methods are therefore not robotic. Equipment that is functionally unrelated to the boring machine must be used for conveying excess earth back to the mouth of the pipeline/tunnel. There are limitations as to the grade of the pipeline/tunnel because the conveying equipment is limited as to grade, and the boring machine is limited as to grade. There are severe limits to the curvatures of the tunnel inasmuch as the boring machine is not inherently steerable.

Furthermore, existing tunneling machines are not positively propelled, but instead depend on conventional railroad truck units on conventional railroad tracks, or alternatively on endless track (i.e., "caterpillar treads") or radial jacks against the earthen walls of the tunnel, rather than against the pipeline/tunnel body completed so far.

Furthermore, existing tunnelling methods that use prefabricated linings do not use them except as a means of shoring up, or lining, the walls of the tunnel by creating an arch exerting only radial forces against the tunnel walls, and/or using the linings for aesthetic purposes. The tunnel walls are the interior surface of the bore cut through the earth, and the linings are used to prevent cave-ins. The linings are not used to provide traction or to solely constitute the tunnel when the boring machine encounters a nonsolid region of the earth. They are indeed linings of the bored tunnel and do not constitute the structural body of the tunnel. In the present invention, the prefabricated structural segments are not linings but are instead the very structural body of the pipeline/tunnel itself, and the structural body can therefore be fabricated through a non-solid region of the earth.

SUMMARY OF THE INVENTION

The present invention installs a plurality of parallel permanent ducts in the wake of a boring unit moving tangentially along a three-dimensional space curve through both solid and non-solid regions of the earth. The ducts are pipelines if of relatively smaller diameter, or are tunnels if of relatively larger diameter. The body of the ducts is a sequence of prefabricated structural segments of metal or solid composite. When the system is operating in a solid region of the subterrain, the earth is initially cut away by the boring unit in a large diameter bore as the boring unit moves ahead. Special conveyor units convey to the boring unit the aforementioned prefabricated liners of appropriate material (for example, metal, composite), and as the ducts are formed the special conveyor units convey the prefabricated structural segments in the ducts to the location immediately aft of the boring unit and there install them. The prefabricated segments as successively installed thus function in the aggregate as the structural body of each duct. The installation of the prefabricated segments is a continual procedure as the ducts are extended.

The interior surface of the duct body is a helical thread or alternatively a wrap-around cylindrical spur rack.

The conveyor units convey surplus earth and navigational information from the boring unit to the mouth of the ducts. They also convey the prefabricated structural segments to be installed, material for the optional filling-in of the annular space between the permanent ducts and the initially cut large-diameter earthen bore, navigational and other control commands, and energy from the mouth of the ducts to the boring unit. The conveyor units move one-way in a pair of ducts; the pair is joined at the boring unit by a U-tube and correspondingly by a fixed U-tube at the beginning of the path. Each pair of ducts and its two U-tubes thereby constitute a closed circuit for the rapid movement of the conveyor units.

Propulsion of the boring unit is provided by hollow traction units in at least three of the parallel ducts. Each traction unit has wheels that are gears that mesh positively with the helical interior surface of the ducts, thus providing positive traction regardless of the instantaneous direction of the ducts. The differential motion of the traction units causes a change in the directional aspect of the boring unit, and thus the boring unit is omnidirectionally steerable. The wheels of each traction unit are both at the top of the unit and at the bottom of the unit.

Each conveyor unit also has gear wheels which mesh with the interior surface of the ducts and the U-tubes. Similarly to the traction units, the gears wheels of the conveyor units are on the top of the unit and also on the bottom of the unit. The conveyor units are thus able to move in the duct regardless of its instantaneous direction. The interior surface of the hollow traction units are similar to the interior surface of the ducts in order to enable the conveyor units to pass through them.

Although three parallel permanent ducts are sufficient for the steering of the boring unit, at least four are provided. The boring unit contains a U-tube joining the ducts of each pair of ducts so that the conveyor units can travel from the mouth of the ducts to the boring unit through one of the two of the pair and return from the boring unit through the other duct of the pair, thereby providing a continual circulation of conveyor units between the boring unit and the location of initial departure of the boring unit at the mouth of the ducts. The conveyor units pass through the hollow traction units in their travels. The use of a fourth duct thereby provides two closed circuits for the more rapid movement of material and information between the mouth of the ducts and the boring unit.

When the boring unit enters a non-solid region of the subterrain, it cannot function as a boring device and its function is to provide the U-tubes to enable the conveyor units to travel in the permanent ducts as closed circuits. Inasmuch as the boring unit plays a role in the installation of the prefabricated structural segments, the steering of the boring unit will cause a change in the direction of the ducts. In this non-solid region, as in the solid region, the body of each duct is structurally comprised of the prefabricated segments that duct.

OBJECTS OF THE INVENTION

The principal objects of the present invention are: to provide an improved system for the totally automated installation of permanent ducts, either of pipeline size or of tunnel size, without any limitations as to distance, direction and depth; to provide such a system by robotically installing prefabricated structural segments to comprise the sole body of the ducts, and to provide for the continuing of the installation of the body of the pipelines or tunnels through a non-solid region of the subterrain. Other objects and advantages of this invention will become apparent from the following description taken in conjunction with the accompanying drawings, wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriately detailed structure and configuration.

The same unit, part, element or subsystem of the system of the present invention carries the same identifying number in all of the drawings.

Figure 1:
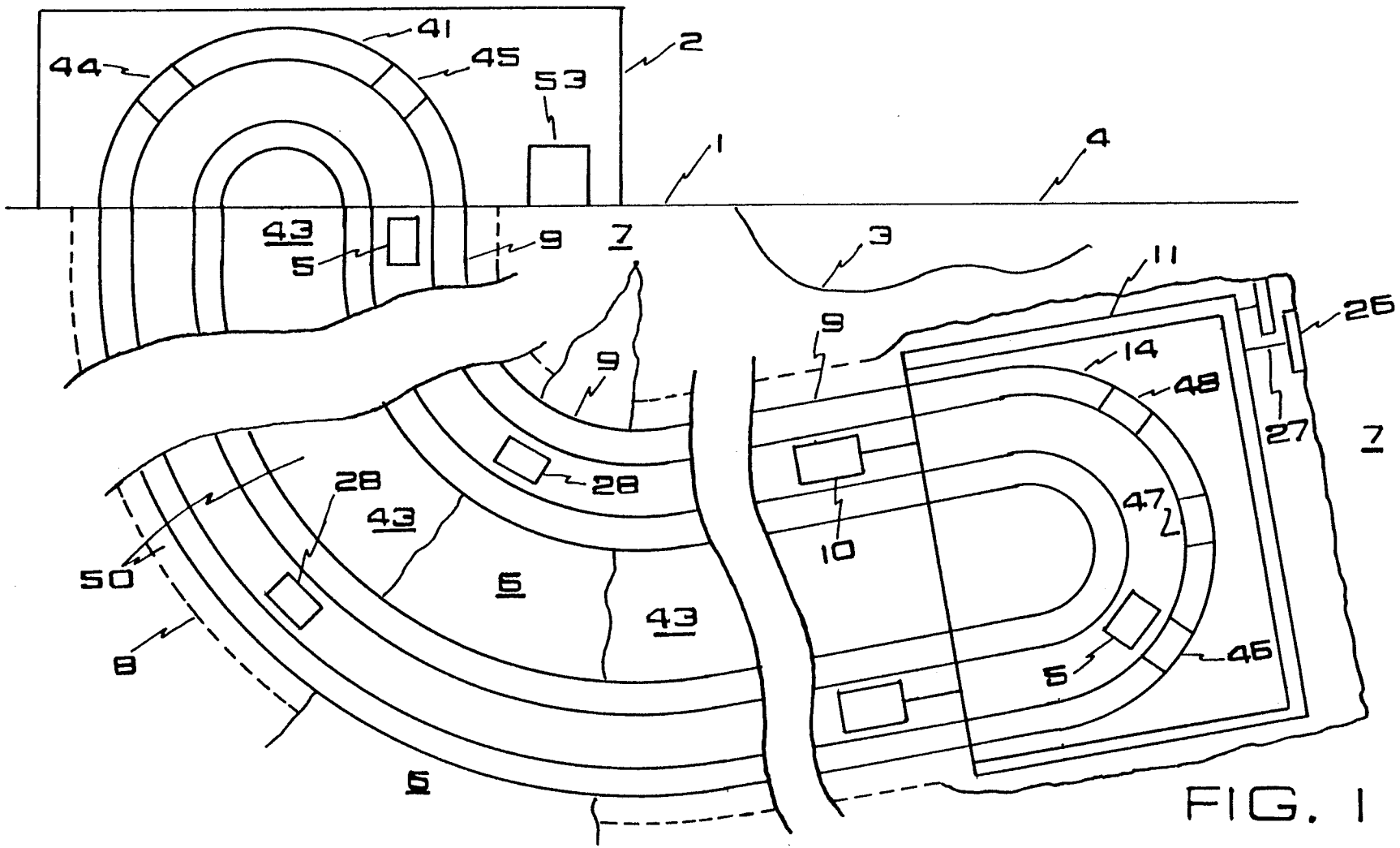
FIG. 1 shows the composite omnidirectional system with boring unit, two of the four parallel permanent ducts constituting a closed circuit for the conveyor units, the conveyor units traveling one-way in the ducts, and the service structure at the beginning of the permanent ducts whence the boring unit initially departs.

In FIG. 1, on the surface of dry land 1 is erected a fixed service structure 2 containing two parallel U-tubes 41, one shown in the plane of the paper and the other in a plane parallel to the plane of the paper. Boring unit 11 departs service structure 2 and moves through the subterrain 7 installing four parallel permanent ducts 42, two of which are shown in the plane of the paper. Ducts 42 are shown being fabricated through a region 6 of subterrain 7 containing a fluid rather than solid as well as through the solid region of subterrain 7. As boring unit 11 moves along its curvilinear path, duct body 9 is constructed of prefabricated segments, as discussed below. Annular space 43 between bore 8 and duct bodies 9 may be optionally filled at selected locations along duct bodies 9 with high-viscosity composite material 50 inserted into annular space 43 at boring unit 11, composite material 50 to subsequently solidify in annual space 43. There being no annular space through fluid region 6, no composite material 50 is inserted during that arc length of ducts 42.

In order to constrain composite material 50, which encases the ducts at selected locations, at a location where boring unit 11 transits from a solid region of the earth to non-solid region 6 of the earth, boring unit 11 dwells at the interface while composite material 50 sufficiently solidifies around the last structural segments of duct bodies 9 that had been completely installed before boring unit 11 enters non-solid region 6. Thus, boring unit 11 contrains composite material 50 until composite material 50 no longer requires constraint, and boring unit 11 then moves further into region 6. When boring unit 11 transits from a non-solid region to a solid region, boring unit 11 advances a distance into the solid region equal to several lengths of structural segment of duct bodies 9 before any composite material 50 is used. With sufficient viscosity, composite material 50 will not slough more than one or two segment lengths before it solidifies, and the loss by the high-viscosity flow of composite material 50 from annular space 43 into non-solid region 6 is negligible. Thus at each selected location, where ducts 9 are encased over one or more lengths of prefabricated structural segments, the beginning of the encasement is marked by a sloughing of the high-viscosity composite material 50, and the end of the encasement is marked by boring unit 11 acting as a restraint against sloughing. The purpose of the occasional encasement is to structurally support the duct bodies 9 within large diameter bore 8, but the encasement is not part of duct bodies 9.

FIG. 1 shows ducts 42 being installed in the subterrain 7 of dry land 1 and in the subterrain of seafloor 3 below sea-surface 4.

Composite material 50 is conveyed to boring unit 11 for insertion into the aforementioned annular space by conveyor units 5, shown in FIG. 1. Alternatively, compositing material is conveyed and mixed with the earth cut by the boring unit 11 in order to form composite material 50. Each conveyor unit 5 at port 44 of U-tube 41 receives composite material 50, or alternatively receives at port 44 the compositing ingredients to make composite material 50 at boring unit 11 as a mixture with the earth cut by boring unit 11. Conveyor units 5 also successively receive navigational instructions for the movement of boring unit 11. Conveyor units 5 then move down one duct of each of the two pairs of ducts, enter U-tube 14 in boring unit 11, successively discharge their contents at port 46, and receive surplus earth through port 47. Each conveyor unit 5 then delivers navigational instructions at port 48, and receives navigational and sensor information at port 48. Each of conveyor units 5 thereupon returns up the other duct 42 of each pair of ducts 42, with its load of surplus earth and the information on the current status of boring unit 11, until it arrives at U-tube 41 in fixed service structure 2 to disgorge the surplus earth at port 45 and to deliver the aforementioned status information into control computer 53 in service structure 2.

Special conveyor units 28 (shown in more detail in FIG. 8, and further discussed below) carry the prefabricated segmented quadrants for the extension of duct body 9 to boring unit 11, and install the quadrants of the next segment of duct body 9 in the gap between the current end of the four ducts 42 and the back end of the forward-moved boring unit 11. Special conveyor units 28 move in the duct-loop alternatively with conveyor units 5 inasmuch as conveyor unit 5 cannot reach U-tube 14 in the boring head until after special conveyor unit 28 installs the prefabricated segment to extend ducts 42. The installation of the pipeline or tunnel is therefore a continual, rather than a continuous, process.

The number and speed of conveyor units 5 and 28 in the closed circuit (formed by each pair of ducts and the two U-tubes) depend at any time on the length of duct bodies 9 already installed and on the forward speed of boring unit 11.

As discussed below, special conveyor units 28 will be used for the progressive installation of segmented duct body 9 as boring unit 11 moves tangentially along its three-dimensional curvilinear path.

When boring unit 11 encounters a region 6 in the earth containing a fluid, either liquid or gaseous or a vapor, the successive installation of prefabricated segments of duct body 9 provides the means of bridging region 6, the bridge being installed as a cantilever bridge. The materials and physical design of the prefabricated segments are of appropriate structural characteristics to structurally support the bridge.

When boring unit 11 encounters solid earth, then the pipelines or tunnels 42 consist of the prefabricated duct body 9 occasionally encased along its arc length in a reinforced concrete or other composite material 50. Exterior protrusions of duct body 9 function as the reinforcement for the encasing composite material 50.

Figure 2:
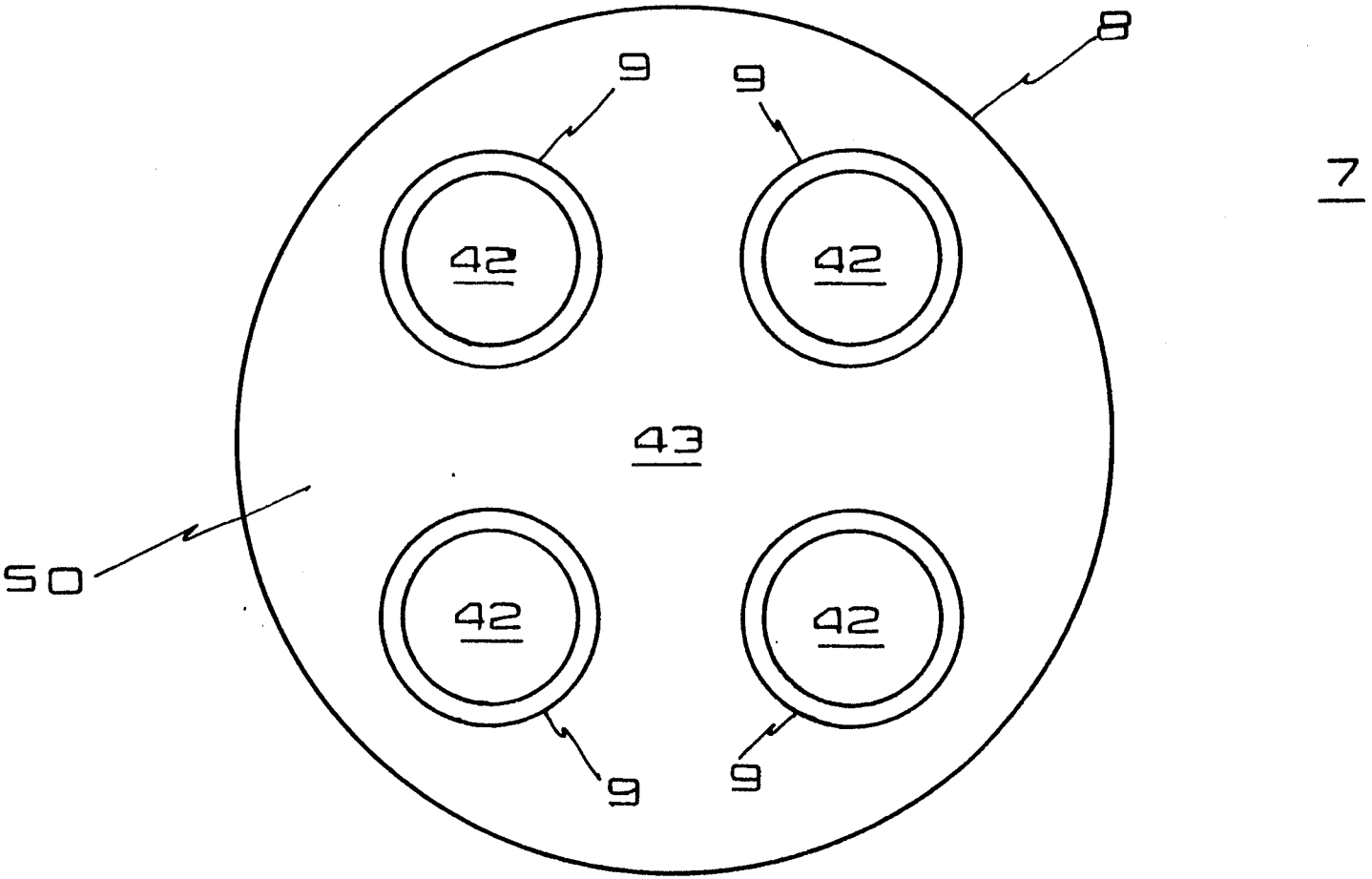
FIG. 2 is a cross-sectional view of the large diameter bore, of four parallel permanent ducts, and of the optional composite material in the annular space between the large-diameter earthen bore and the bodies of the ducts.

FIG. 2 is a cross-sectional view of four parallel permanent ducts 42 each with duct body 9 occasionally encased along its arc length in composite material 50 in annular space 43 between the duct body 9 and the large diameter bore 8 originally made by boring unit 11 in subterrain 7. Although, as discussed below, three ducts would be sufficient to steer boring unit 11 omnidirectionally to tangentially follow a three-dimensional curvilinear path, a fourth duct 42 provides two closed circuits rather than one for the conveyor units 5 and 28.

Figure 3:
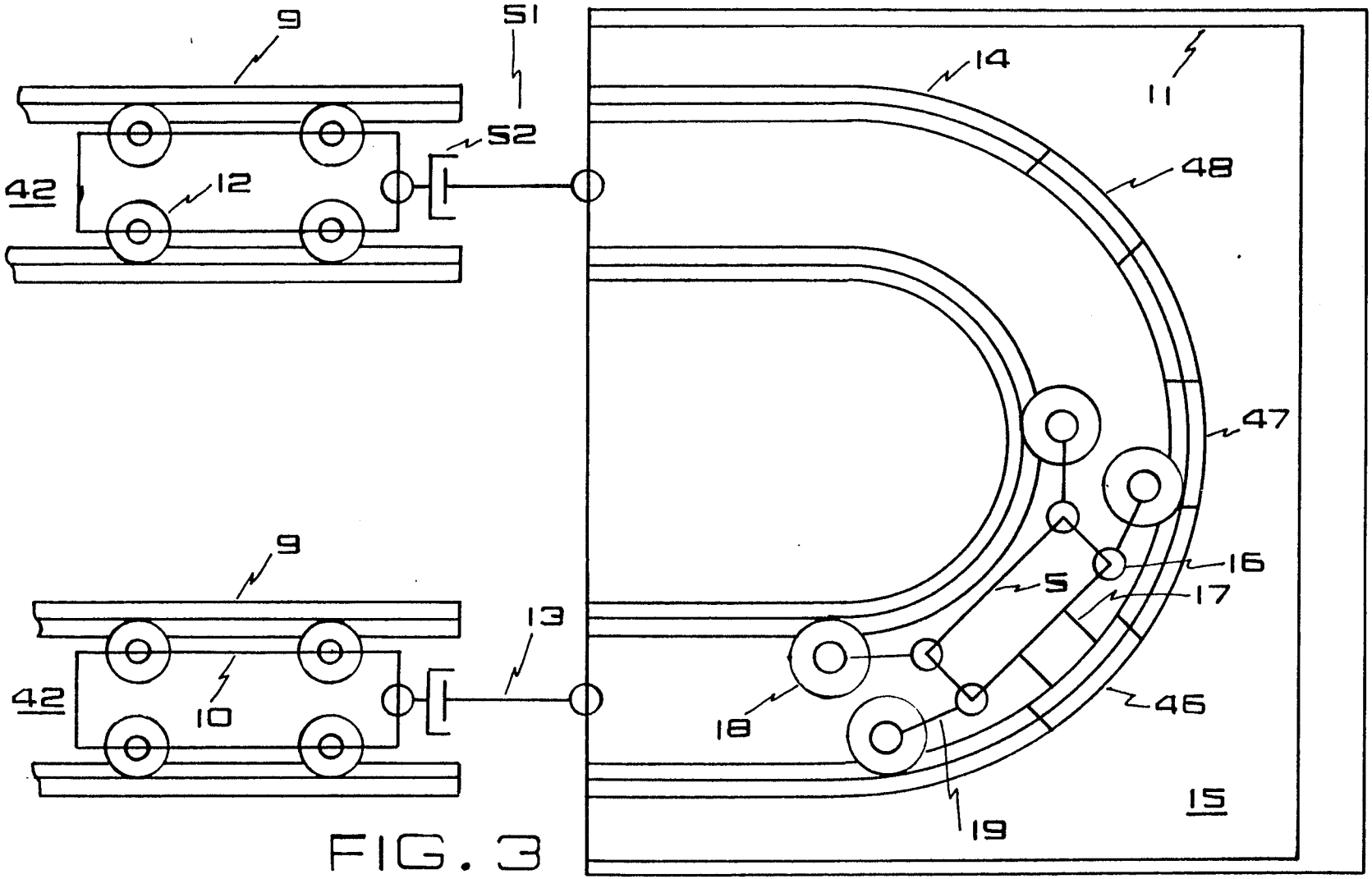
FIG. 3 is a longitudinal view of the boring unit showing one of the two parallel U-tubes, two of the permanent ducts associated with that U-tube, the traction units in the two ducts, and a conveyor unit in the U-tube.

In FIG. 3, boring unit 11 is coupled to, and supported by, traction units 10 located in the permanent ducts 42 already constructed. The coupling and support between each traction unit 10 and boring unit 11 are by means of at least two links 13 (each link containing linear motor 52) at the outer rim of traction unit 10 so as to not impede the motion of conveyor units 5 and 28 through the hollow body of traction unit 10. The prefabricated segments making up duct body 9 have an interior surface that is a wrap-around rack to mesh with a spur gear or have a helical machine-screw surface to mesh with a helical gear. The entire interior surface of duct body 9 is therefore a wrap-around rack meshing with the gear wheels 12 of traction unit 10 thereby providing traction unit 10 with positive traction.

A conveyor unit 5 is shown in U-tube 14 at port 46 discharging the material it carried from service structure 2. The material is transmitted, from conveyor unit 5 to internal space 15 of boring unit 11, through conduit 17 and port 46. Gear wheels 18 of conveyor unit 5 mesh with the interior gear-rack surface of U-tube 14, and gear wheels 18 support conveyor unit 5 through extension linkages 19 hinged to the body of conveyor unit 5 by hinge 16. Hinged linkages 19 enable conveyor unit 5, and also special conveyor unit 28, to pass through hollow traction units 10.

Gap 51 has been caused by the positive (rather than frictional) movement of traction units 10 in ducts 9, thereby advancing boring unit 11 relative to stationary ducts 9, either against the solid face of the large diameter bore in subterrain 7 or into non-solid region 6. It will be the function of special conveyor units 28 to fill gap 51 in all four ducts 9 using successively installed prefabricated structural segments of duct body 9. The differential movement of the four traction units 10 causes a change in the direction of boring unit 11.

When a curvature in the ducts is intended to be caused by the steering of boring unit 11, control computer 53 selects prefabricated segments with short arc lengths for the next extensions of duct body 9, to be loaded onto the next special conveyor unit 28 to be dispatched from service structure 2 to arrive at boring unit 11. A succession of special conveyor units 28 are dispatched at the same time in order to fill gap 51 by a sequence of segments before the next conveyor unit 5 is dispatched.

The traction forces of traction units 10 are transmitted to boring unit 11 by structural links 13 each containing an in-line linear motor 52. Two parallel structural links 13, each at the perimeter of traction unit 10, are used in order to avoid impeding the passage of conveyor units 5 and 28 through hollow traction units 10. Linear motors 52 are used to obtain a greater degree of control over the differential steering movement of boring unit 11.

Figure 4:
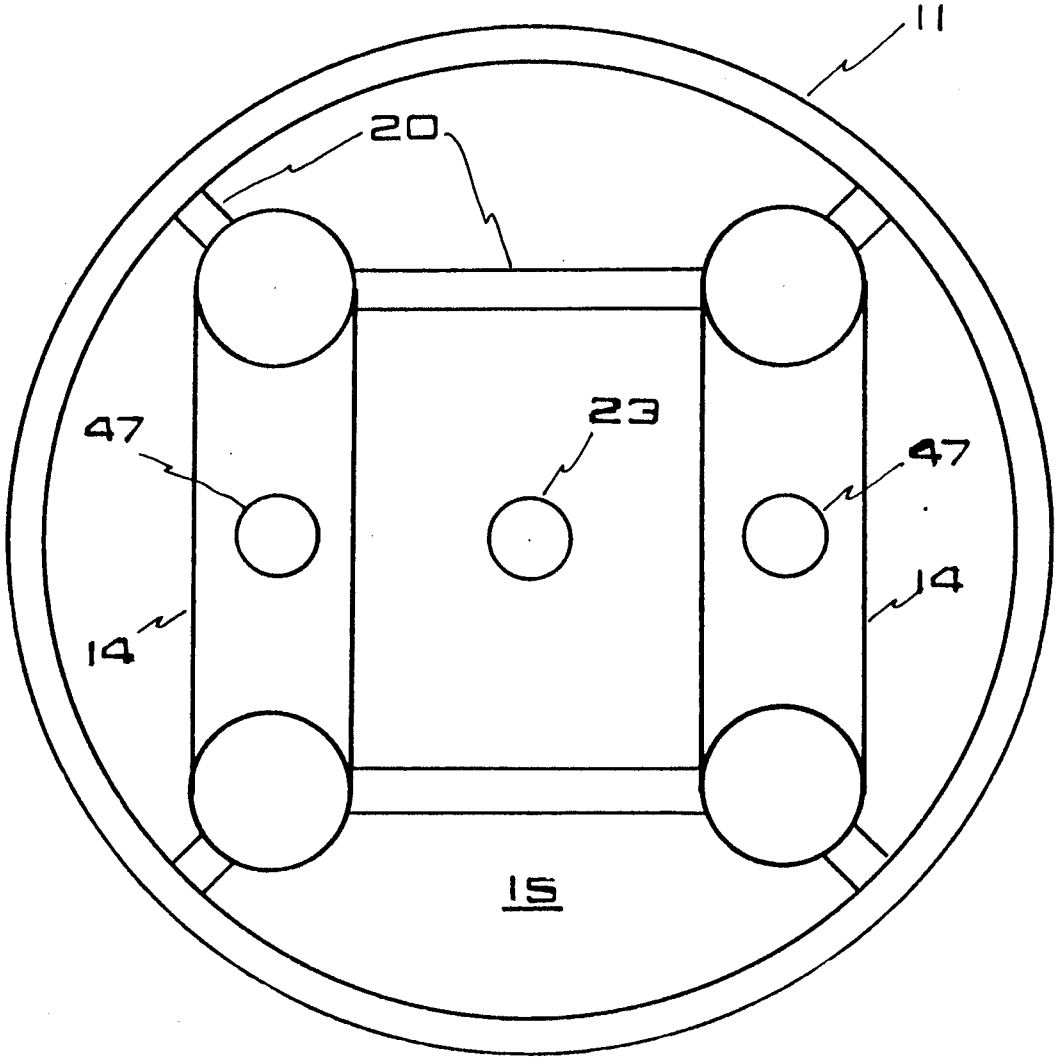
FIG. 4 is a cross-sectional frontal view of the boring unit showing the two U-tubes, each connecting two of the ducts, and the structure supporting the U-tubes in the boring unit.

The configuration of the two U-tubes 14 in boring unit 11 is shown in the end view of boring unit 11 in FIG. 4. Structural members 20 support U-tubes 14 in boring unit 11, as shown. If boring unit 11 is in a solid region of subterrain 7, annular space 15 is filled with composite material 50 or compositing material brought from service structure 2 by conveyor units 5. Prime mover 21 is coaxial with boring unit 11, is supported in boring unit 11 by structure 20, and it is further discussed below with reference to FIG. 5.

Figure 5:
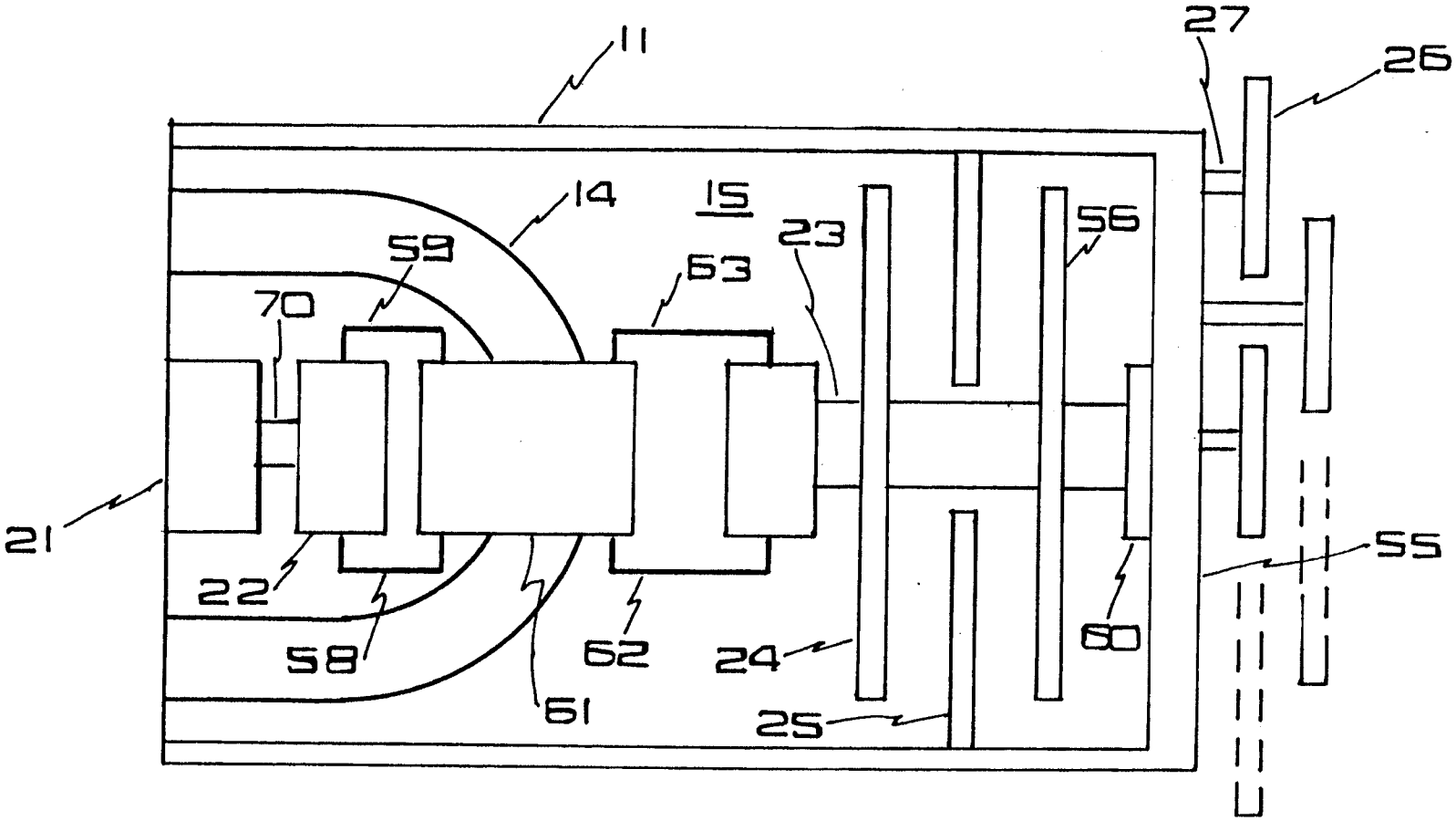
FIG. 5 is a longitudinal view of the boring unit showing the prime mover, the fluidic generator, the rotating and stationary disks for the reduction of the cut earth to small particle size, and several of a plurality of rotary cutting tools.

Referring to FIG. 5, after gap 51 is filled by the extending of duct body 9, disk 24 (mounted on rotatable shaft 23) in boring unit 11 is driven by fluidic rotary motor 57, and when disk 24 is rotating, disk 24 forces composite material 50 into annular space 43 around the newly installed extensions of the four parallel ducts 42, wherever it is desirable to do so in order to support the entire duct body 9 within the large diameter bore 8. The surface of rotating disk 24 is not flat but is suitably curved so as to cause movement of composite material 50 backwards along the axis of rotation into annular space 43 when disk 24 is rotated. Rotating disk 56 is perforated and together with stationary perforated disk 25 grinds the earth material cut from the solid region of subterrain 7 so as to be reduced in particulate size so as to better mix with compositing ingredients to form composite material 50 if composite material 50 is a concrete-like material.

Still referring to FIG. 5, rotary prime mover 21 drives rotary fluidic generator 22 through shaft 70, and generator 22 in turn provides the fluidic power for all motors, both linear and rotary, in boring unit 11 and traction units 10. Fluid lines 58 and 59 connect generator 22 to control unit 61, and fluid lines 62 and 63 specifically connect control unit 61 to rotary fluidic motor 57 driving shaft 23. Bearing 60 is mounted in perforated face plate 55 of boring unit 11, and supports the forward end of shaft 23. Face plate 55 has a high ratio of its surface perforated by holes to permit the debris cut from the earth to enter space 15 of boring unit 11.

Figure 6:
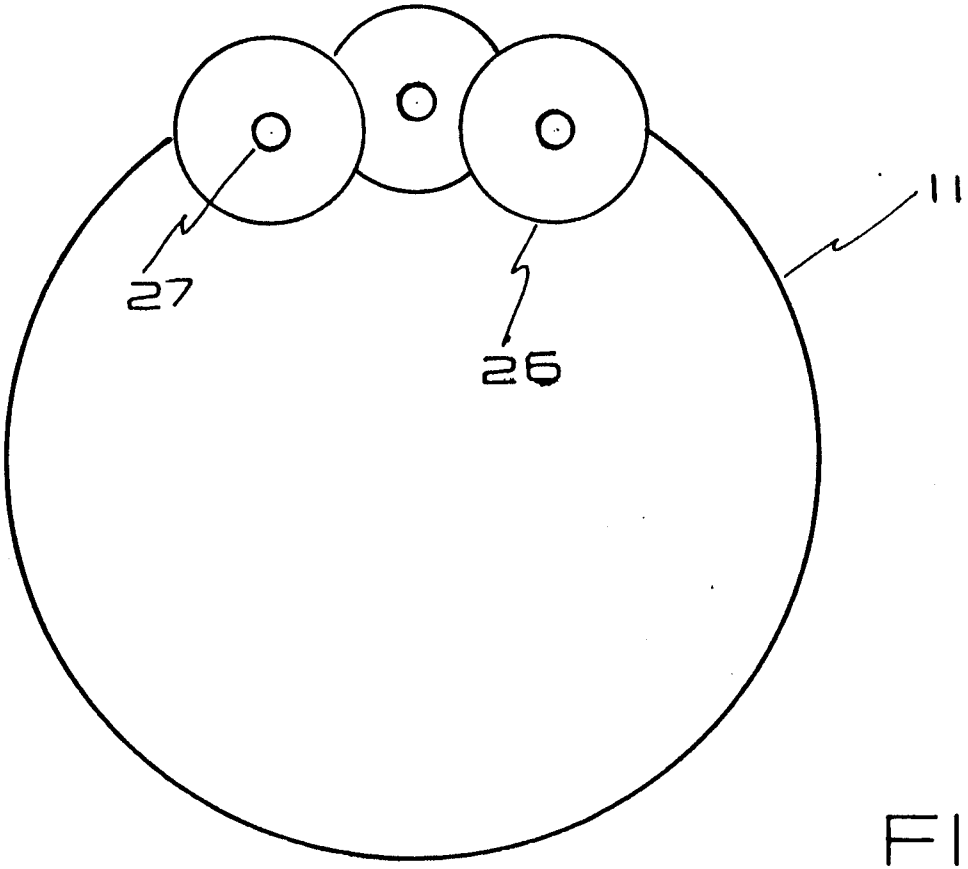
FIG. 6 shows the frontal view of the boring unit and a typical arrangement of rotary cutting tools when rotary cutting tools are used.

The system of the present invention can be used with any feasible kind of tool for the cutting of the face of the earth to create the large diameter bore. In FIG. 5, by way of example, are shown rotary cutters 26 driven by rotary motors 27 mounted to face plate 29. Any set of rotary cutters would alternately rotate clockwise and counterclockwise, from cutter to cutter, in order to minimize the reactive torque on boring unit 11. Cutters 26 are shown to be staggered both longitudinally and across face plate 29, and an end view is shown in FIG. 6 of three of the entire array of cutters.

Figure 7:
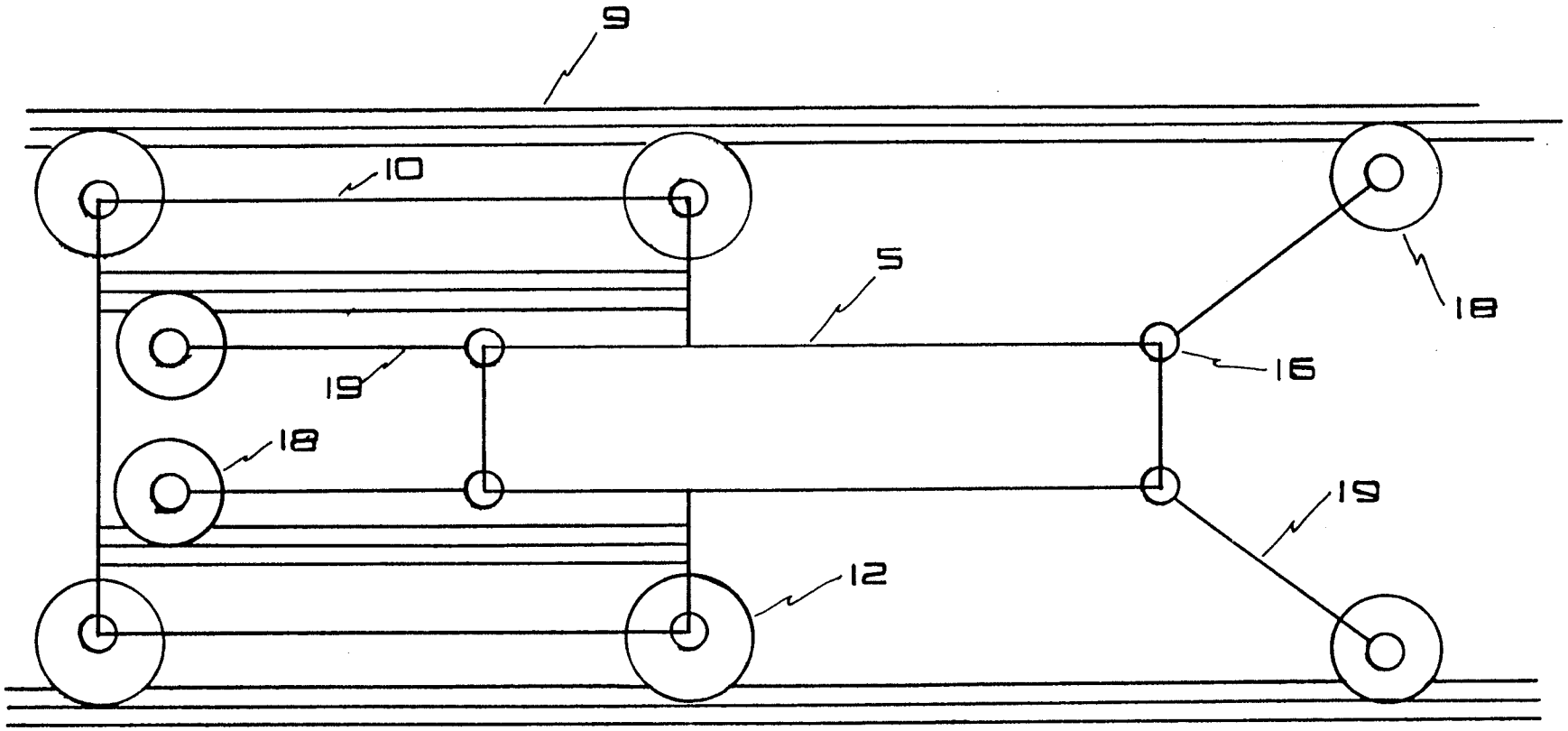
FIG. 7 shows a conveyor unit moving through the hollow traction unit.

In FIG. 7, a conveyor unit 5 is moving through the hollow body of traction unit 10. Gear wheels 12 mesh positively with the gear-rack interior surface of duct body 9. Similarly, gear wheels 18 of conveyor unit 5 mesh positively with the interior gear-rack surface of duct body 9 when wheels 18 are outside traction unit 10. When gear wheels 18 are inside traction unit 10, gear wheels 18 mesh positively with the gear-rack interior surface of traction unit 10. The adjustment between the two interior gear-rack surfaces is made by linkage 19 rotating at hinge 16. Traction unit 10 has a minimum of eight gear wheels, a minimum of four on "top" and four on the "bottom." Similarly, conveyor unit 5 and special conveyor unit 28 each has a minimum of eight gear wheels, a minimum of four "on top" and a minimum of four "on the bottom."

Figure 8A:
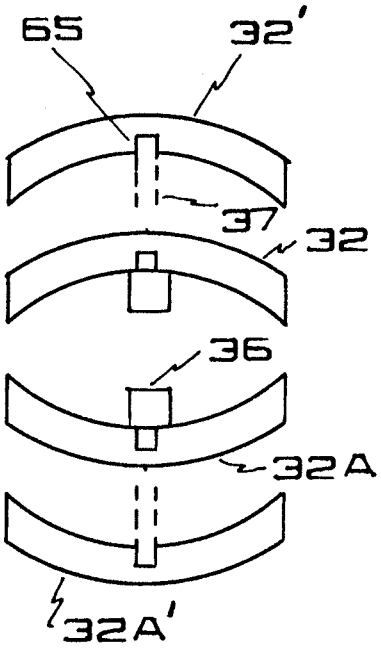
FIG. 8A is a sectional view taken along lines A—A of FIG. 8.
Figure 8:
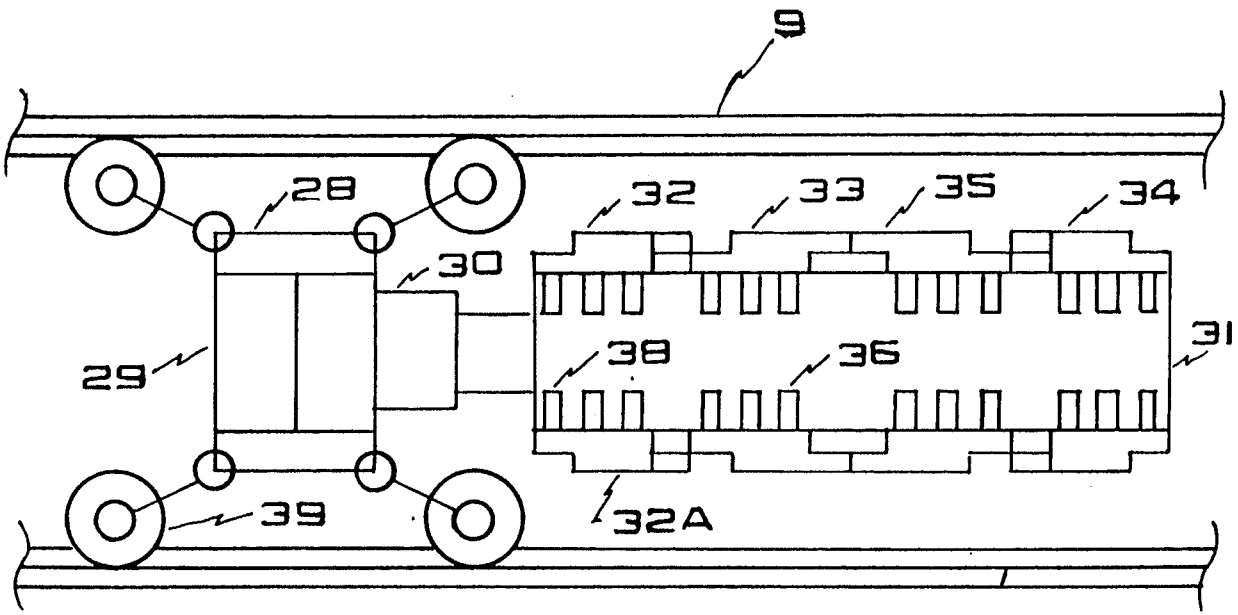
FIG. 8 shows the special conveyor unit for the installation of the prefabricated structural segments.

Special conveyor unit 28 is shown in more detail in FIG. 8. Gear wheels 39 mesh positively with the interior gear-rack surface of duct body 9, or when going through traction unit 10 mesh positively with the interior gear-rack surface of traction unit 10. Rotary motor 29 supports and rotates linear motor 30, and linear motor 30 supports and longitudinally moves spindle 31. The common axis of rotary motor 29, linear motor 30 and spindle 31 is able to be nutated relative to the axis of the main body of special conveyor unit 28, by gimbals and rotary motors not shown, in order to accommodate curvatures in the axes of the permanent ducts 42. Spindle 31 has a right circular cylindrical surface on which are initially mounted at service structure 2 eight quadrants, four quadrants 32, 33, 34 and 35 riding "on the top" of spindle 31 and four corresponding quadrants 32A, 33A, 34A and 35A riding "on the bottom" of spindle 31. The installation of these quadrants to extend the pipeline/tunnel body 9 creates an extension of the pipeline or tunnel.

Figure 9:
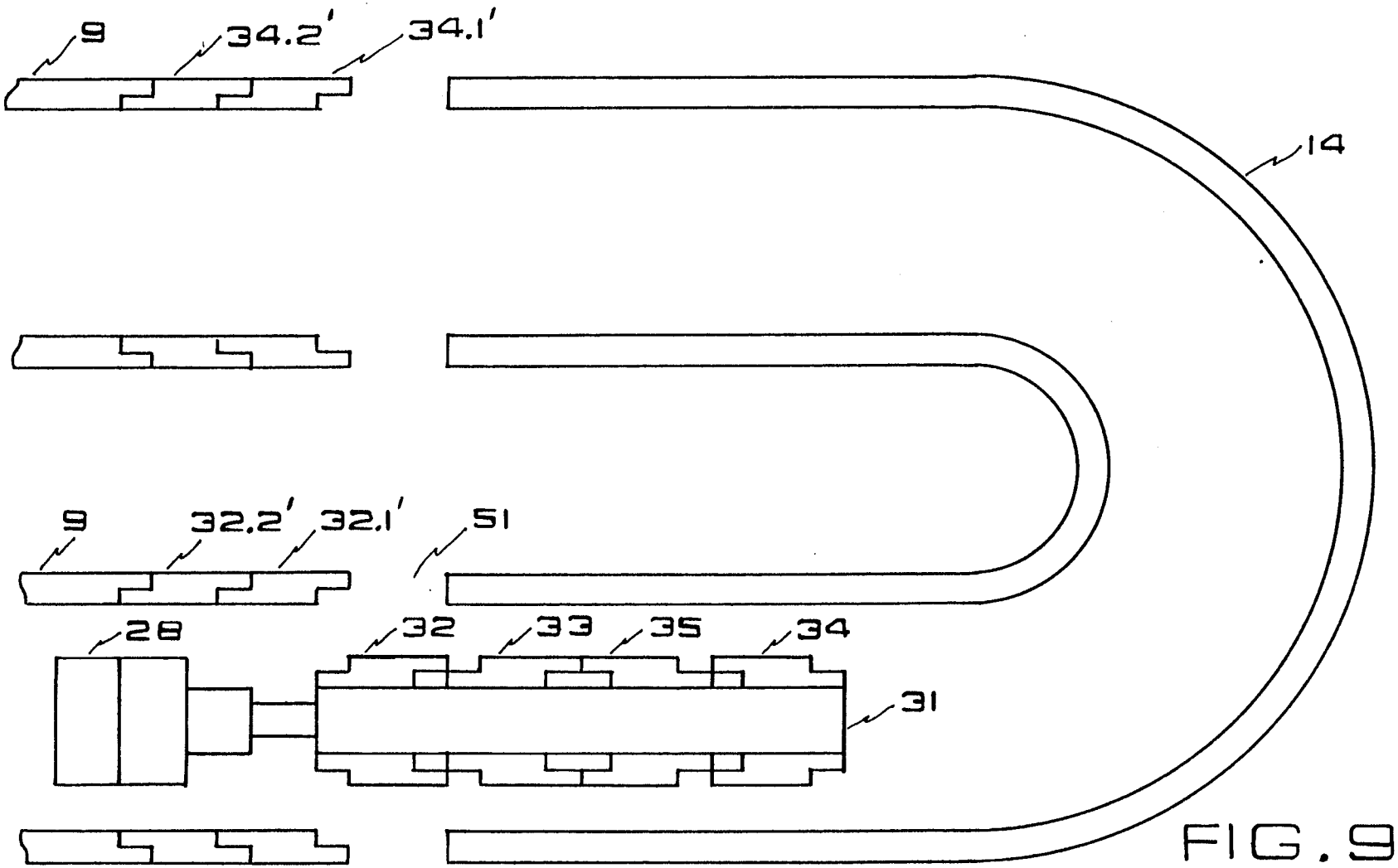
FIG. 9 shows the special conveyor unit (for the installation of the prefabricated structural segments) in one of the ducts of a pair of ducts.
Figure 11:
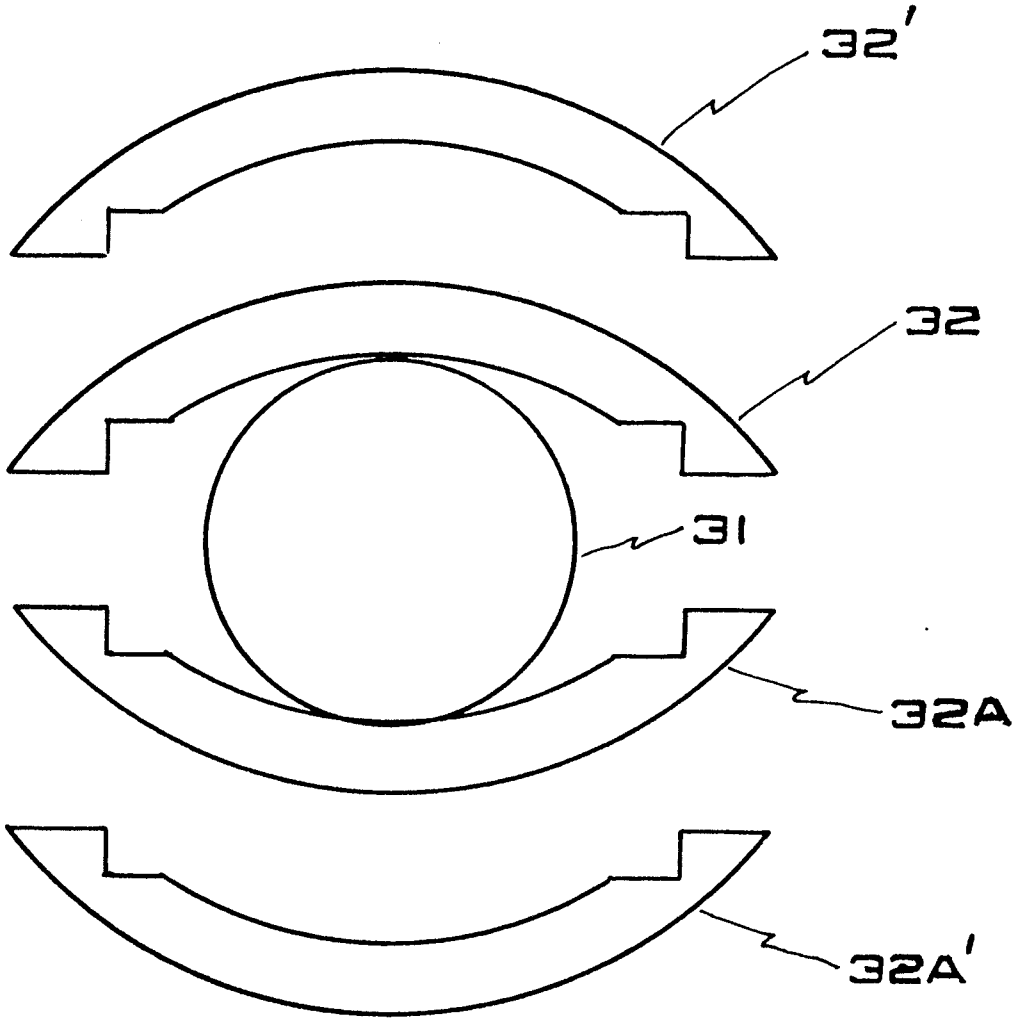
FIG. 11 shows a cross-sectional view of two of the four quadrants of a prefabricated structural segment in their location on the conveyor unit and their location in their final position, as part of the extension of each permanent duct.

Still referring to FIG. 8, the end view shows quadrants 32 and 32A raised into place as quadrants 32' and 32A', respectively. This positioning of each quadrant is accomplished by two or more linear motors 36 radially embedded in spindle 31, and radially extending their arms 37. The end of each arm 37 is inserted into holes 65 in its quadrant in order to maintain the position of the quadrant when extended. Now referring to FIGS. 13 and 14, the arm 49 of linear motor 38 holds a pin 40 loosely fitting in its hole 54 in quadrant 32. With quadrant 32 held in place as quadrant 32' by linear motors 36, linear motor 38 uses its arm 49 to force pin 40 into the matching hole 64 of quadrant 32.1' of the immediately previous segment of duct body 9. The diameter of hole 54 is larger than the shank diameter of pin 40 (but less than the diameter of the head of pin 40) in order to accommodate the rotational displacement of the axis of the contemporaneously installed duct segment relative to the axis of the immediately previously installed duct segment. The relative rotational displacement is effected by the rotational displacement of the axis of spindle 31 relative to the axis of special conveyor unit 28. This procedure fastens the quadrant of the new segment to the corresponding quadrant of the previous segment at the correct angular displacement of axes of the two segments in order to provide curvature in permanent ducts 42. Linear motors 36 then withdraw their arms 37 leaving the quadrants 32 and 32A firmly in place and attached. A further end view of quadrants 32' and 32A' in place is shown in FIG. 11. FIG. 9 shows the position in duct body 9 of special conveyor unit 28 for the procedure just described.

Figure 12:
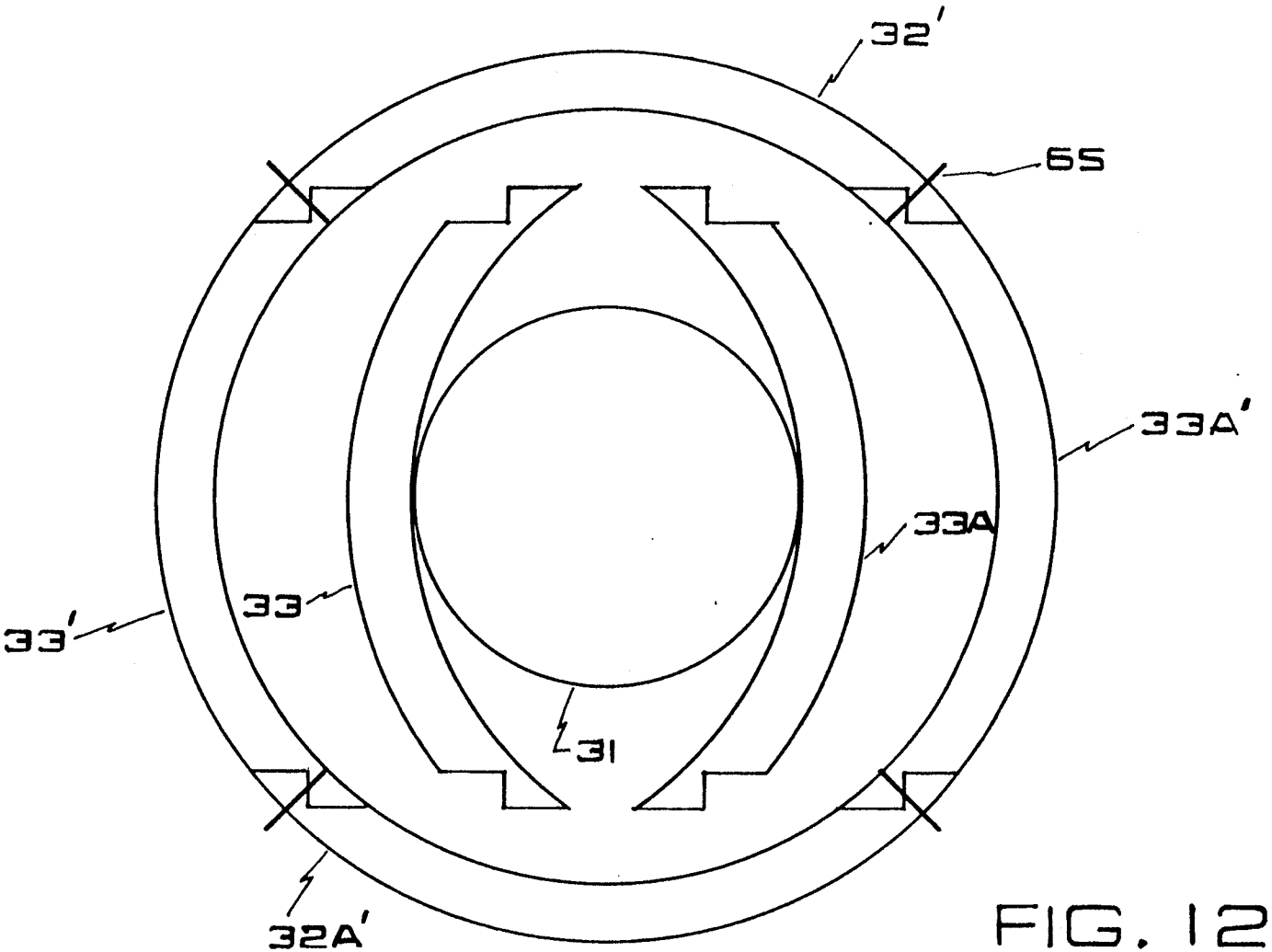
FIG. 12 shows a cross-sectional view of the other two of the quadrants of a prefabricated structural segment in their location on the conveyor unit after the 90-degree rotation of the spindle carrying them, and then their location in their final position as the remaining quadrants of the segment for the extension of the permanent duct.

Rotary motor 29 of special conveyor unit 28 now rotates linear motor 30 and spindle 31 on their common axis ninety degrees, and conveyor unit 28 withdraws into duct body 9 until quadrants 33 and 33A are in gap 51. FIG. 12 shows the new angular position of quadrants 33 and 33A relative to special conveyor unit 28 after the rotational displacement of spindle 31. The same procedure is now performed to fasten newly placed quadrants 33' and 33A' to the previous 33.1' and 33.1A', respectively. Also, four pins 65 are driven to fasten 32', 33', 32A' and 33A' to each other, as shown in FIG. 12. The four quadrants 32', 32A', 33' and 33A' now constitute the newly installed segment of duct body 9 in the "lower" duct thereby filling gap 51 in that duct.

Figure 14:
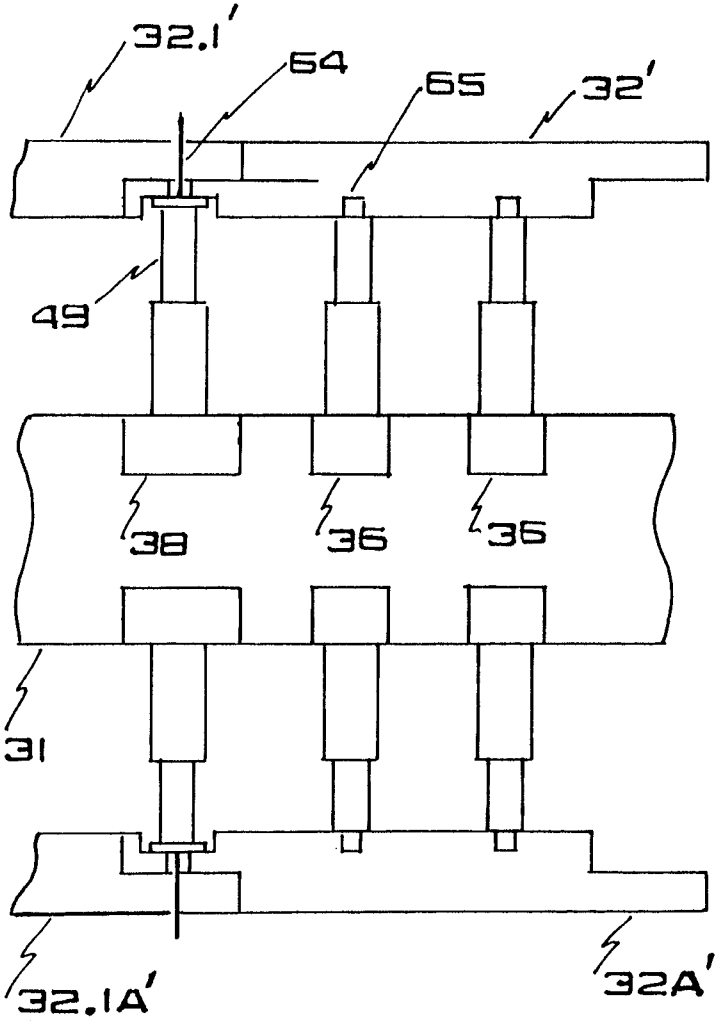
FIG. 14 shows the quadrant moved into place by the linear motors that support it, and the fastening tool forcing the fastening pin into place to fasten the quadrant to the corresponding quadrant of the previous segment.
Figure 13:
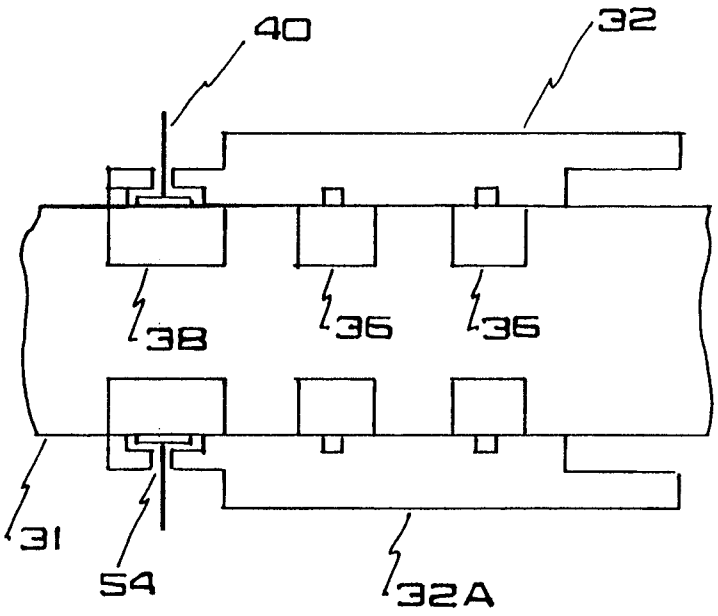
FIG. 13 shows a quadrant of a prefabricated segment resting on the spindle of its installing conveyor unit, and the linear motors holding the quadrant and the fastening tool.

In FIGS. 13 and 14, the use of linear motors 36 to raise quadrant 32 into place as quadrant 32' is shown in greater detail. Also, the use of rectilinear tool 38 through extension arm 49 to force or drive pin 40 into hole 64, in order to fasten quadrant 32' to 32.1' and 32A' to 32.1A', is shown in greater detail. FIG. 13 shows the quadrants on spindle 31 of special conveyor unit 28, and FIG. 14 shows the quadrants raised into place to become part of the new segment of permanent duct 9.

Figure 10:
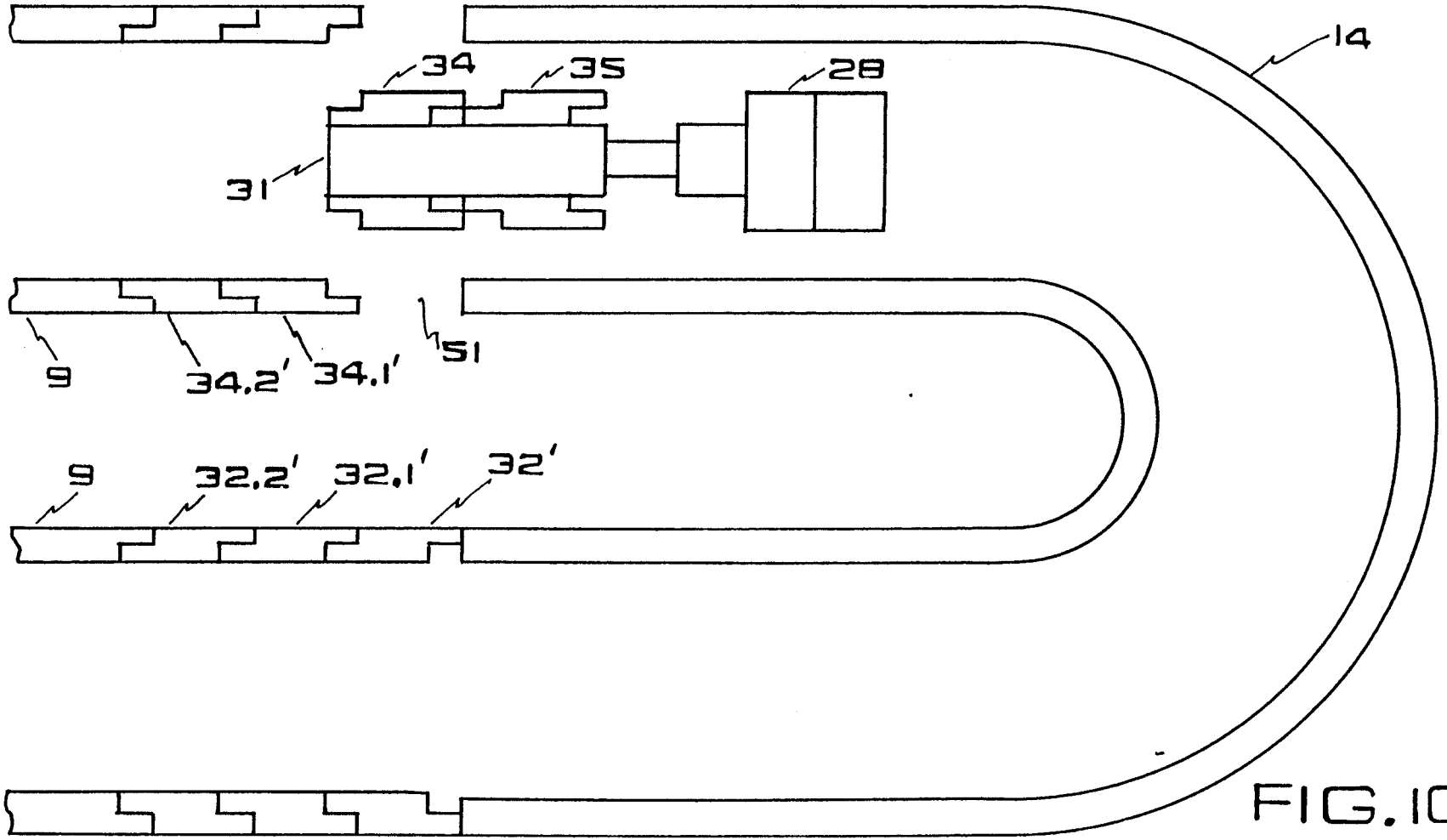
FIG. 10 shows the same special conveyor unit in the other duct of a pair of ducts, to complete the extension of the ducts.

Linear motor 30 (shown in FIG. 8) of special conveyor unit 28 now withdraws spindle 31 to one-half its extended length. Special conveyor unit 28 subsequently crosses the newly installed segment of duct body 9, enters and traverses U-tube 14, and now comes to rest as shown in FIG. 10. Spindle 31 was reduced in length in order for special conveyor unit 28 to more readily traverse U-tube 14. The overall procedure previously followed to install the segment in the "lower" duct is now followed with quadrants 34, 34A, 35, and 35A to fill the gap in the "upper" duct shown in FIG. 10. When this gap is filled by the installation of the new segment of the "upper" duct, special conveyor unit 28 has completed its task and returns nonstop and one-way in the "upper" duct to service structure 2.

This entire procedure is followed in all four ducts by two special conveyor units 28, each special conveyor unit 28 operating in each loop. Once the four gaps in the four ducts have been filled by the heretofore described procedures for the installation of the extensions of duct body 9, plate 24 (shown in FIG. 5) is rotated by rotary motor 57 to force the composite material 50 in space 15 into the annular space around the new extensions of duct 42 wherever it is desirable along duct 42 to encase duct 42, assuming that the extensions are located in a solid region of the subterrain. If they are not, then the extensions can not encased, or if encasement is not desired, then the extensions are not encased. Boring unit 11 is now advanced by traction units 10, a new set of gaps 51 is created, and the entire sequence of events heretofore described is repeated to install the next segment of each duct body 9.

What is claimed and desired to be secured by Letters Patent is as follows:

1. A method for the robotic fabrication of a plurality of structurally independent parallel permanent ducts along unlimited three-dimensional curvilinear paths in a solid region of the earth comprising:

advancing an omnidirectionally steerable boring unit of a first diameter through said solid region to form a closed-periphery bore by loosening material from a work face; and continually installing prefabricated segments of each of a plurality of said structurally independent parallel permanent ducts of a smaller diameter behind said boring unit in order to continually extend said permanent ducts directly behind said boring unit as said boring unit continually advances.

2. The method of claim 1 including means for the installation of said prefabricated segments to form said structurally independent permanent ducts.

3. The method of claim 1 including means for supplying said prefabricated segments to form said structurally independent permanent ducts.

4. The method of claim 1 wherein:

material loosened from the solid earth by advancing said boring unit is treated to form a duct-encasing material thereof; and inserting said duct-encasing material as an occasional encasement of said structurally independent permanent ducts in the wake of said advancing boring unit.

5. The method of claim 1 including means to occasionally encase said structurally independent permanent ducts by a duct-encasing material not dependent on material loosened from the solid earth.

6. The method of claim 3 wherein said means does not interfere with the advancing movement of said boring unit.

7. The method of claim 5 including means to occasionally encase said prefabricated segments with a duct-encasing material different than that of said prefabricated segments.

8. The method of claim 1 wherein each of said permanent ducts has an interior helical or spiral surface coaxial with the longitudinal axis of said permanent duct.

9. The method of claim 1 wherein a longitudinal section of each of said permanent ducts is a parallel pair of interior spur-gear racks.

10. The method of claim 4 including means for the conveying of compositing material to said boring unit for the treating of said material cut from said work face, and for the formation of said encasing material.

11. The method of claim 10 wherein said means does not interfere with the advancing movement of said boring unit.

12. The method of claims 4 and 5 wherein said duct-encasing material is installed as an encasement of said permanent ducts.

13. The method of claim 12 wherein said means does not interfere with the advancing movement of said boring unit.

14. The method of claim 1 including means for the conveying of movement instructions to said boring unit, and means for the conveying of movement information from said boring unit.

15. The method of claim 14 wherein said means does not interfere with the advancing movement of said boring unit.

16. The method of claim 1 including means for the removal of excess material cut from said work face by said boring unit.

17. The method of claim 16 wherein said means does not interfere with the advancing movement of said boring unit.

18. The method of claim 1 wherein:

said boring unit is advanced by a plurality of traction units, each of said traction units moving in each of the plurality of said permanent ducts; and the movement of each of said traction units is independent of the movement of each of the other traction units.

19. The method of claim 18 wherein said traction units structurally support said boring unit.

20. The method of claim 18 wherein each of said traction units has wheels which are gear wheels positively meshing with said interior surface of said permanent duct.

21. The method of claim 18 wherein said boring unit is omnidirectionally steered by the differential translational movement of said traction units.

22. The method of claim 18 wherein each of said traction units has wheels that support said traction unit at rotational intervals around the entire perimeter of said traction unit.

23. A method for the robotic fabrication of a plurality of structurally independent parallel permanent ducts along unlimited three-dimensional curvilinear paths in a non-solid region of the earth comprising:

advancing an omnidirectionally steerable boring unit into said non-solid region;

structurally supporting said boring unit by means of a parallel plurality of structurally independent permanent ducts previously installed behind said advancing boring unit;

installing prefabricated segments of a plurality of said structurally independent parallel permanent ducts of a smaller diameter behind said boring head in order to continually extend said permanent ducts directly behind said boring unit as said boring unit continually advances; and continually replicating the advancing of said boring unit and the installing of the next segments of said plurality of parallel permanent ducts until said non-solid region of the earth has been bridged.

24. The method of claim 23 including means for supplying said prefabricated segments to form said structurally independent permanent ducts.

25. The method of claim 24 wherein said means does not interfere with the advancing movement of said boring unit.

26. The method of claim 23 including means for the installation of said prefabricated segments to form said structurally independent permanent ducts.

27. The method of claim 23 wherein each of said permanent ducts has an interior helical or spiral surface coaxial with the longitudinal axis of said permanent duct.

28. The method of claim 23 wherein a longitudinal section of said permanent ducts is a parallel pair of interior spur-gear racks.

29. The method of claim 23 including means for the conveying of movement instructions to said boring unit, and means for the conveying of movement information from said boring unit.

30. The method of claim 29 wherein said means does not interfere with the advancing movement of said boring unit.

31. The method of claim 1 wherein:

said boring unit being advanced by a plurality of traction units, each of said traction units moving in each of the plurality of said permanent ducts; and the movement of each of said traction units is independent of the movement of each of the other traction units.

32. The method of claim 31 wherein said traction units structurally support said boring unit.

33. The method of claim 31 wherein each of said traction units is provided with wheels which are gear wheels positively meshing with said interior surface of said permanent duct.

34. The method of claim 31 wherein said boring unit is omnidirectionally steered by the differential movement of said traction units.

35. The method of claim 31 wherein each of said traction units has wheels that support said traction unit at rotational intervals around the entire perimeter of said traction unit.

* * * * *